US009617128B2

(12) United States Patent
Maurice et al.

(10) Patent No.: US 9,617,128 B2
(45) Date of Patent: Apr. 11, 2017

(54) PULLEY DEVICE

(71) Applicant: ZEDEL, Crolles (FR)

(72) Inventors: Alain Maurice, Saint Hilaire du Touvet (FR); Pierre-Olivier Chabod, Pontcharra (FR); Alexandre Bronnaz, Bassens (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 14/584,397

(22) Filed: Dec. 29, 2014

(65) Prior Publication Data

US 2015/0183624 A1 Jul. 2, 2015

(30) Foreign Application Priority Data

Dec. 27, 2013 (FR) ..... 13 03095

(51) Int. Cl.

| | |
|---|---|
| ***A62B 1/14*** | (2006.01) |
| ***B66D 3/04*** | (2006.01) |
| ***B66D 3/02*** | (2006.01) |
| ***B66D 3/06*** | (2006.01) |

(52) U.S. Cl.

CPC ..... *B66D 3/06* (2013.01); *A62B 1/14* (2013.01); *B66D 3/02* (2013.01); *B66D 3/04* (2013.01); *B66D 3/046* (2013.01)

(58) Field of Classification Search

CPC ... B66D 3/02; B66D 3/04; B66D 3/06; B66D 3/046; A62B 1/14

USPC ..... 254/399

See application file for complete search history.

(56) References Cited

U.S. PATENT DOCUMENTS 1,740,821 A * 12/1929 Kneuper ..... E21B 43/121 198/497
1,764,512 A * 6/1930 Hume ..... B66D 3/10 24/115 R
1,890,992 A * 12/1932 Janssen ..... B66D 3/10 188/65.1
2,704,981 A * 3/1955 Gustafson ..... E21B 43/121 198/525
2,841,020 A * 7/1958 Van Deventer, IV .... F16H 7/18 139/84
3,068,316 A * 12/1962 Witt ..... H02G 11/02 174/135
3,112,816 A * 12/1963 Halford ..... B66D 3/10 188/65.2
4,047,272 A * 9/1977 King ..... D06H 7/12 242/525.7

(Continued)

FOREIGN PATENT DOCUMENTS

WO 2005/089873 A1 9/2005

*Primary Examiner* — Emmanuel M Marcelo
*Assistant Examiner* — Michael Gallion
(74) *Attorney, Agent, or Firm* — Oliff PLC

(57) ABSTRACT

The pulley device comprises first and second pulleys each provided with a set of sheaves. The two pulleys are designed to be respectively fixed to a fixed point and to a person to be rescued. A rope is fixed to one of the two pulleys and arranged in such a way that the first pulley moves towards the second pulley when a pull is exerted on the rope. An enclosure connects the first pulley to the second pulley and surrounds the path of the rope between the two pulleys. One end of the rope extends outwards from the enclosure to enable a pull to be exerted on the end of the rope.

16 Claims, 4 Drawing Sheets

(56) References Cited

U.S. PATENT DOCUMENTS 4,347,680 A * 9/1982 Kaestner ..... A01K 73/06 254/394
4,867,276 A * 9/1989 Tamietti ..... A62B 35/005 182/233
4,979,614 A * 12/1990 Ruhaut ..... B65H 75/362 174/135
5,048,456 A * 9/1991 Bouix ..... D01F 11/126 118/718
5,048,670 A * 9/1991 Crafton ..... F04B 19/14 198/643
5,211,297 A * 5/1993 Vandervalk ..... B66C 23/42 212/179
5,400,869 A * 3/1995 Rocourt ..... A62B 1/14 182/133
D374,174 S * 10/1996 McClellan ..... D13/154
5,615,865 A * 4/1997 Fountain ..... B66D 3/10 254/269
5,725,112 A * 3/1998 Thorby ..... B66C 23/44 212/180
6,152,675 A * 11/2000 Compton ..... B60P 1/5495 212/299
6,189,867 B1 * 2/2001 O'Rourke ..... B66D 3/04 254/391
6,234,453 B1 * 5/2001 Block ..... B66C 23/208 212/296
6,301,752 B1 * 10/2001 Koppang ..... B65H 75/36 24/115 M
6,595,494 B1 * 7/2003 Roodenburg ..... B66C 13/02 254/277
6,601,829 B2 * 8/2003 Graham ..... B66D 3/10 254/391
6,892,857 B2 * 5/2005 Baker ..... A62B 1/20 182/138
6,908,074 B2 * 6/2005 Eiwan ..... B66D 3/043 254/390
6,978,974 B1 * 12/2005 Marasco ..... A63H 17/12 248/124.1
7,156,246 B2 * 1/2007 Sherrod ..... B66C 23/44 212/180
7,214,092 B1 * 5/2007 Platt ..... B65H 75/36 439/501
7,448,944 B1 * 11/2008 Baumler ..... A22B 7/001 452/187
2001/0004022 A1 * 6/2001 Kobayashi ..... B60R 16/0207 174/72 A
2002/0100900 A1 * 8/2002 Graham ..... B66D 3/10 254/391
2002/0148461 A1 * 10/2002 Heinz ..... A61F 5/03 128/96.1
2004/0026675 A1 * 2/2004 Green ..... B66C 23/06 254/326
2005/0119527 A1 * 6/2005 Banik ..... A61B 1/00059 600/117
2007/0181863 A1 * 8/2007 Plzak ..... B66D 3/04 254/338
2010/0032632 A1 * 2/2010 Maire ..... B66D 3/06 254/399
2010/0192330 A1 * 8/2010 Walker ..... B65H 75/362 24/129 R
2011/0031203 A1 * 2/2011 Chapman ..... B66C 23/701 212/196
2014/0021421 A1 * 1/2014 Torben ..... B66D 1/50 254/277
2014/0138191 A1 * 5/2014 Chabod ..... A62B 1/14 188/65.1
2015/0173993 A1 * 6/2015 Walsh ..... A61H 3/00 414/4

* cited by examiner

FIGURE 3a
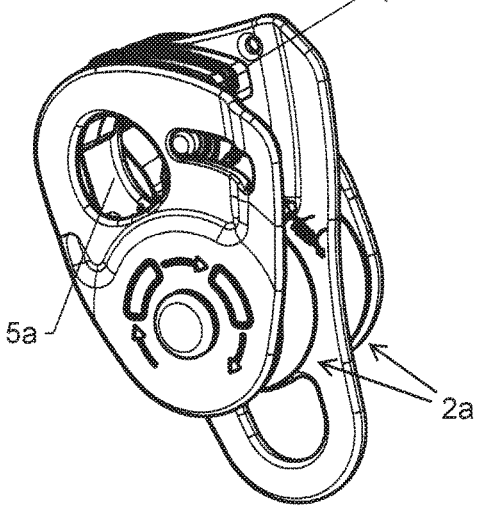
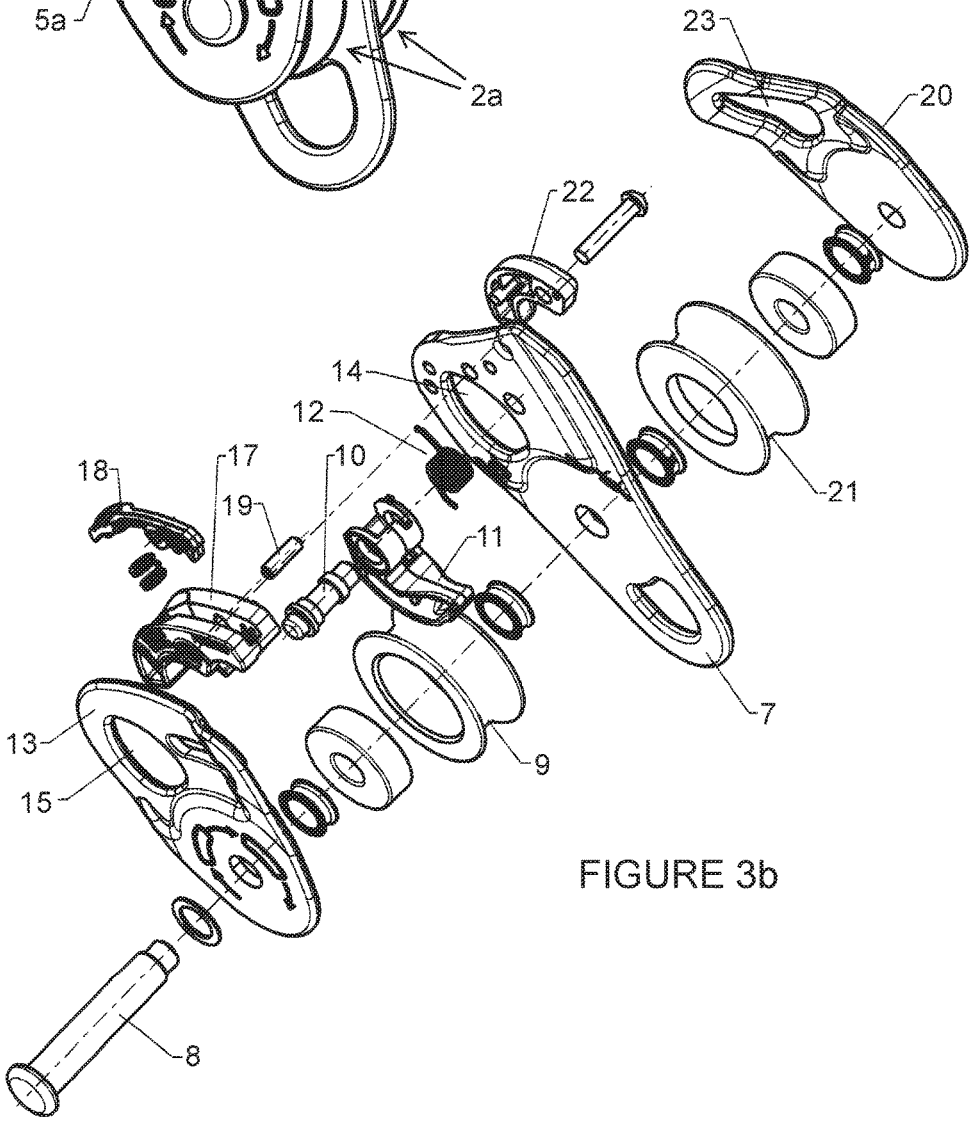
FIGURE 3b

FIGURE 4a
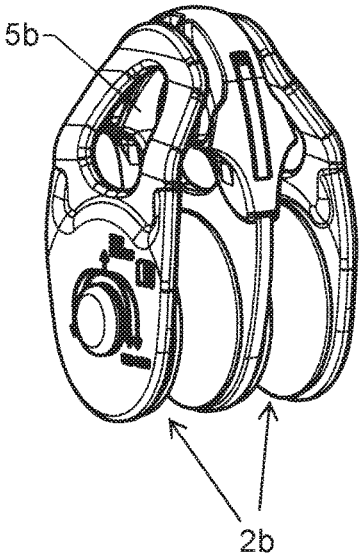
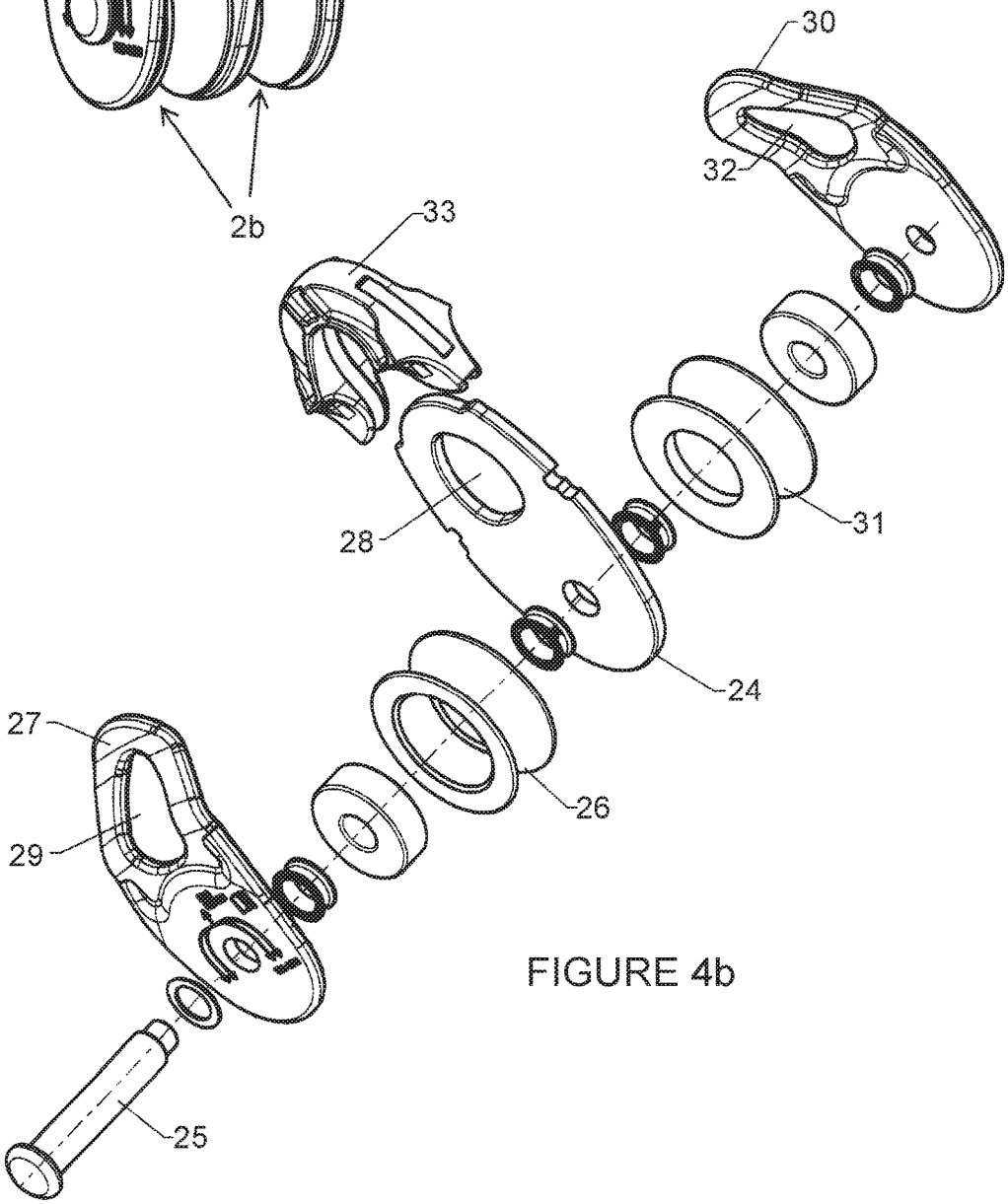
FIGURE 4b

PULLEY DEVICE

BACKGROUND OF THE INVENTION

The invention relates to a pulley device.

STATE OF THE ART

In mountaineering, when a fellow climber has fallen into a crevasse, or in a more general manner when a person is stuck on a rope strand, it is important to be able to lift the person in distress in order to improve his/her situation.

Pulley techniques are commonly used as they enable the force applied to be multiplied enabling a large weight to be lifted in an environment that is not always suitable for this.

The pulley technique commonly uses one or more pulleys enabling a mechanical advantage to he had, and a self-locking device to facilitate the operation.

This situation happens very rarely, but it is particularly stressful. This situation does in fact happen unexpectedly (falling into a crevasse, accident) and the person who has to provide assistance for the person in distress at the same time has to ensure his/her own safety and economise his/her energy in order to avoid making the situation even worse. When these extraordinary situations arise, the person to be rescued may quite often be injured or even unconscious which makes him/her incapable of taking any part in his/her own rescue operation.

The person performing the rescue operation therefore has to have a perfect mastery of the pulley technique and also enough self-control to handle this situation.

OBJECT OF THE INVENTION

It is observed that a requirement exists to provide a pulley device that is ready-to-use and easily transportable.

This requirement tends to be met by means of a pulley device which comprises:

- First fixing means designed to be fixed to a fixed point and comprising a first set of at least two pulleys,
- Second fixing means designed to be fixed to a person to be rescued and comprising a second set of at least two pulleys,
- A rope fixed to one of the two fixing elements and arranged to connect at least two pulleys of the first fixing means with at least two pulleys of the second fixing means so that the first fixing means move towards the second fixing means when a pull is exerted on the rope,
- An enclosure connecting the first fixing means to the second fixing means and surrounding the path of the rope between the two fixing means, one end of the rope extending outwards from the enclosure to enable a pull to be exerted on said end.

BRIEF DESCRIPTION OF THE DRAWINGS

Other advantages and features will become more clearly apparent from the following description of particular embodiments of the invention, given for non-restrictive example purposes only and represented in the appended drawings, in which:

FIGS. 3*a*, 3*b*, 4*a* and 4*b* represent, in schematic manner, perspective views and exploded views of the fixing means.

DESCRIPTION OF PREFERRED EMBODIMENTS OF THE INVENTION

Figure 1:
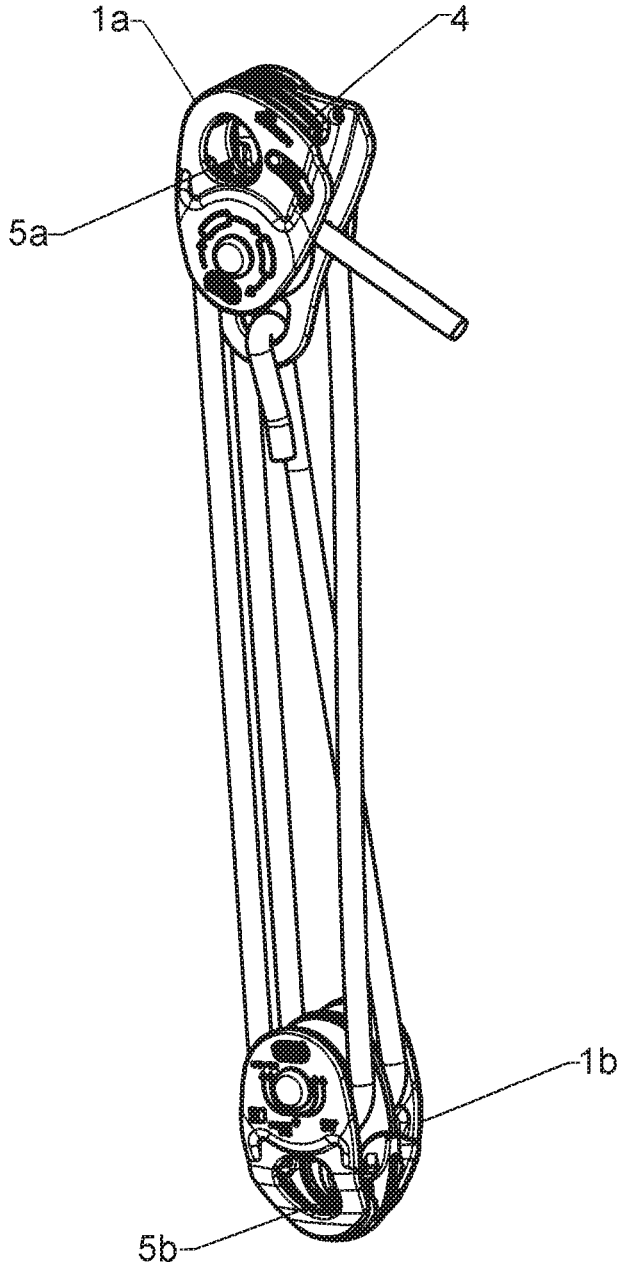
FIG. 1 represents, in schematic manner, a pulley device without its enclosure.

The pulley device comprises first and second fixing means 1*a* and 1*b* advantageously comprising and/or formed by first and second pulleys. First pulley 1*a* is designed to be mechanically connected to a fixed point. Second pulley 1*b* is designed to be mechanically connected to the person to be rescued.

In a first situation, first pulley 1*a* is connected directly or indirectly to a fixed relay or point. Second pulley 1*b* is connected to the rope which is securing the person to be rescued. In this configuration, the person to be rescued is lifted by pulling on the rope which is securing him/her. This scenario can occur when the person has fallen into a crevasse or when a second climber is blocked.

In a second situation, first pulley 1*a* is connected directly or indirectly to a relay by means of the rope which initially secures the person to be rescued. Second pulley 1*b* is connected directly or indirectly to the person to be rescued. The person to be rescued is then supported by the pulley device which enables displacement of the person to be rescued to be organised for example on another rope.

The two situations indicated above are given for example purposes. Other situations can be envisaged.

First pulley 1*a* comprises a first sheave 2*a* and preferably a first set of at least two sheaves 2*a* mounted side by side. Second pulley 1*b* comprises a second sheave 2*b* and preferably a second set of at least two sheaves 2*b* also mounted side by side. What is meant by mounted side by side is that the two sheaves are laterally offset along the axis of rotation of the two sheaves. In advantageous manner, the pivot-pins of sheaves 2*a* and 2*b* are coaxial. It can also be envisaged to provide for the two sheaves 2*a* and/or 2*b* not to share the same axis and for them to be perpendicularly offset with respect to the axis of rotation, but this configuration is less advantageous as it is less compact. What is meant by sheave is a wheel with a groove, i.e. the mobile part in which a rope is wound.

The two pulleys 1*a* and 1*b* are connected by means of a rope 3 or a wire connector. Rope 3 is advantageously fixed to one of the pulleys 1 to achieve a gain in compactness so that the fixed connection on the fixing means defines one end of the rope. Advantageously, the rope is knotted to an aperture of one of the pulleys. In preferential manner, the aperture is made in a fixed flange-plate of the pulley.

Rope 3 passes through the sets of sheaves 2. The path taken by rope 3 is such that it moves alternately from one of the fixing means to the other fixing means. In the embodiment illustrated in FIG. 1, rope 3 is fixed to first pulley 1*a*, and is then wound partially around one of sheaves 2*b* of second pulley 1*b* and then runs back in the direction of first pulley 1*a*. Rope 3 is wound around one of sheaves 2*a* and then again takes the direction of second pulley 1*b*. Rope 3 then leaves the second pulley for first pulley 1*a*. Rope 3 is then made available to be able to be handled by the user.

Rope 3 can take any path between the different sheaves so long as a pull on rope 3 translates into a movement of the two pulleys 1*a* and 1*b* towards one another. In this way, a pull exerted on rope 3 results in the two pulleys 1*a* and 1*b* being moved towards one another.

In advantageous manner, first and/or second pulley 1*a* and 1*b* comprise a self-locking part 4. Self-locking part 4 is configured to allow the two pulleys 1*a* and 1*b* to move towards one another and to prevent them from moving away from one another. In this way, a pull exerted on rope 3 will result in movement of the second pulley with respect to first pulley 1*a* which enables for example the person to be rescued to be lifted. If the rescuer lets go of rope 3 deliberately or involuntarily, the distance between the two pulleys 1*a* and 1*b* is maintained so long as self-locking part 4 is not deactivated.

In a particularly advantageous embodiment illustrated in FIGS. 1, 3 and 4, first and second pulleys 1*a* and 1*b* are formed by double pulleys, i.e. with two sheaves secured to one another, which enables an efficient mechanical advantage to be had without a large volume.

In a preferential configuration, first and second pulleys 1*a* and 1*b* comprise a pass-through opening 5*a*/5*b* for a karabiner (not represented) to pass through. This configuration is particularly advantageous as it enables the karabiner to be changed quickly for another karabiner having a size and/or shape that is more suitable for the specific requirements of the user. As a variant, it is also possible to provide an attachment system fitted on the pulleys, but this configuration is less practical. The karabiner can be replaced by any other removable connector, for example a chain link, a shackle and possibly a strap.

As the sheaves are securedly fixed to the pulley, a single anchoring point is used for each of pulleys 1*a*/1*b* which enables a maximum efficiency to be had as the two groups of sheaves are facing one another. The path taken by rope 3 is then natural and devoid of any friction point.

The pulley device also comprises an enclosure 6. Enclosure 6 is configured to be fixed to first and second pulleys 1*a* and 1*b*. Advantageously, enclosure 6 is configured to be mounted in removable manner which allows access to the inside of the pulley device. Enclosure 6 is configured so as to cover the path of rope 3 between sheaves 2*a*/2*b* and to allow the end used to perform pulling of rope 3 to exit.

The pulley device being designed to only be used in exceptional cases, the device is stored in a bag with the rest of the equipment. It has been discovered that enclosure 6 connecting the two pulleys 1*a*/1*b* and defining a sheath around the multiple paths of rope 3 prevents knots from forming. When the device is not used and in the absence of enclosure 6, it has been observed that knots may occur or that the different rope paths get tangled up. Under these conditions, the pulley device is unusable, and the different constituent parts then have to be disassembled which is particularly nerve-racking.

The use of enclosure 6 enables the arrangement of the pulley device and more particularly the different passages of rope 3 between sheaves 2*a* and 2*b* to be imposed.

Figure 2A:
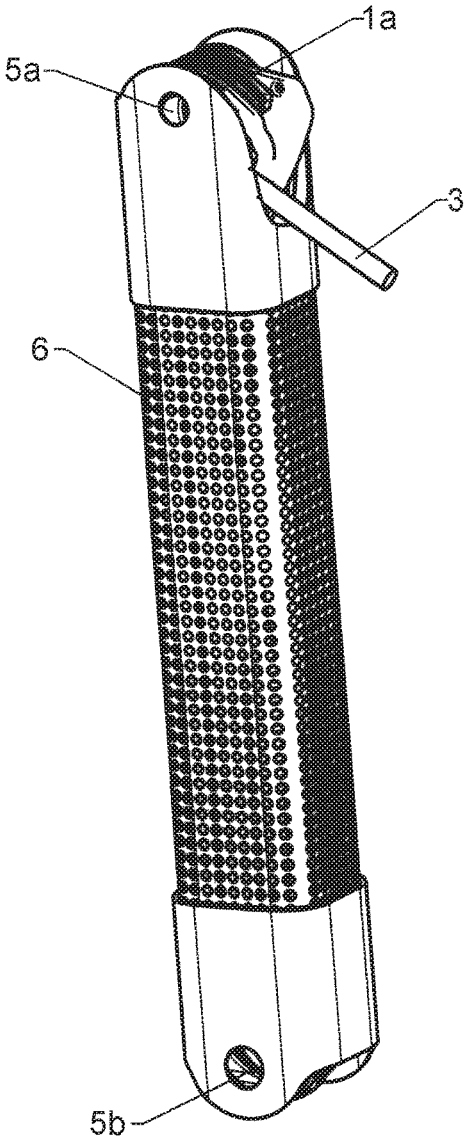
FIGS. 2*a* and 2B represent, in schematic manner, a pulley device with its enclosure in an elongated configuration and in a shortened configuration.
Figure 2B:
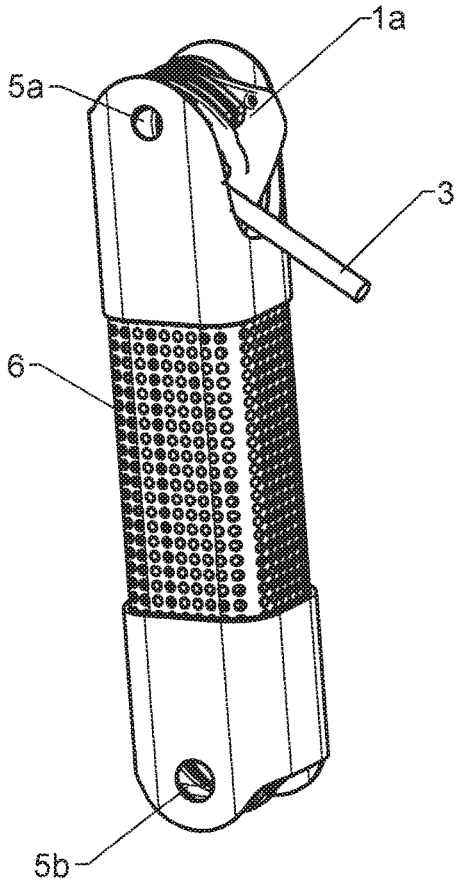

As illustrated in FIGS. 2*a* and 2*b*, enclosure 6 is flexible in a first direction in order to enable adjustment of the length between an elongate position where the two fixing devices 1*a* and 1*b* are away from one another and a shortened position where the two fixing devices 1*a* and 1*b* are close to one another (after a pull has been exerted on rope 3). This flexibility can translate into a compressibility of the enclosure when the rope is pulled.

Enclosure 6 is advantageously flexible in another direction in order to enable the device to be easily stowed away. This freedom of movement in several directions does not hamper operation of the device while at the same time resulting in a drastic reduction of the risks of knots or tangling of the rope. In operation, the device is stretched taut and therefore linear.

This configuration for example enables the pulley device to be folded in order to save space. This also allows a torsion of the central part of the device when the latter is stored.

Enclosure 6 can be formed by a continuous material drilled with holes, by a material drilled with holes or by an assembly of these two materials. Enclosure 6 is advantageously made from a material of textile type which enables a good malleability with a negligible extra weight. Enclosure 6 is at least partially formed from a compressible material so as not to create a force opposing movement of the two fixing means towards one another when a pull is exerted on rope 3. The continuous material can be a fabric which enables the inside of the device to be protected and reduces the amount of dirt penetrating therein.

The material drilled with holes is for example a netting which enables wear of the rope inside the pulley device or of another element to be quickly detected for enhanced safety. Advantageously, the netting is made from a polymer material which facilitates drying, for example from a material of elastane type.

In a particularly advantageous configuration, the portion of enclosure 6 in contact with first and/or second pulleys 1*a*/1*b* is made from a more rigid material than that used to surround the multiple passages of rope 3. These portions in contact with the two pulleys 1*a*/1*b* advantageously form the ends of enclosure 6. Formation of a more rigid enclosure 6 at the ends enables a better operation of the device as it reduces the risk of deformation of the enclosure in the proximity of the sheaves which prevents undesirable blocking. In advantageous manner, the material forming the ends of the enclosure is a more rigid material, for example leather or an injected flexible plastic material, a coated fabric advantageously of PVC or polyurethane type. The increased rigidity can be obtained by providing a thicker material. Increasing the rigidity at the ends reduces the risks of the enclosure deforming around the sheaves and of jamming between a sheave and the rope.

Preferably, the portions in contact with fixing means 1*a*/1*b* are fixed to said fixing means which prevents undesired movement of enclosure 6 in the course of use and limits the risks of jamming in the sheaves. In a particular configuration, the portions in contact with pulleys 1*a*/1*b* comprise an aperture which operates in conjunction with aperture 5 present in pulleys 1*a* and 1*b*. In this way, the karabiner performs fixing of enclosure 6 with pulley 1*a*/1*b*. It is then possible to easily dismantle pulley 1*a*/1*b* by removing the karabiners. The extra weight is limited as there are no superfluous parts.

In the embodiment illustrated in FIGS. 3*a* and 3*b*, first pulley 1*a* is a pulley with a releasable clamp associated with a single pulley. These two elements are mechanically associated in order to form a first monoblock pulley 1*a*.

The pulley with integrated clamp presents reduced overall dimensions and an ease of use which are particularly advantageous.

As illustrated in FIG. 3*b*, first pulley 1*a* has a first fixed flange-plate 7 acting as support for a first pivot-pin 8 of a rotary roller 9 and for a second pivot-pin 10 for pivoting of a blocking trigger 11.

The two pivot-pins 8, 10 are fixed and advantageously extend in parallel manner to one another in a direction perpendicular to first flange-plate 7. Cylindrical roller 9 is mounted rotating freely around first pivot-pin 8 and is provided at its periphery with an annular groove for guiding rope 3 in the sheave.

Pivoting trigger 11 is provided with a braking surface designed to press rope 3 against roller 9 to form an integrated clamp in the space between the two pivot-pins 8, 10. The braking surface comprises a plurality of inclined dots designed to enhance the blocking effect of the rope when the clamp is active. A spring 12 biases trigger 11 towards roller 9.

A movable second flange-plate 13 is fitted rocking on the end of first pivot-pin 8 between a closed position and an open position. The open position of second flange-plate 13 enables rope 3 to be fitted, after trigger 11 has been removed to the inactive position, moving it away from roller 9. In the closed position of second flange-plate 13, rope 3 is wound in a loop on roller 9 and is held captive in the transverse gap arranged between the advantageously parallel flange-plates 7, 13.

First flange-plate 7 comprises a first aperture 14 located near to second pivot-pin 10 and above rotary roller 9. Second flange-plate 13 is provided with a second aperture 15, which comes into alignment with first aperture 14 when the two flange-plates 7, 13 are positioned in the closed position. The two apertures partly define aperture 5*a*. It is then possible to insert a removable connector therein to secure flange-plates 7, 13 in this position preventing any undesirable rocking.

A block 17 fixed to first flange-plate 7 is located above first aperture 14, occupying the transverse gap between flange-plates 7, 13. Block 17 is equipped with a latch 18 designed to swivel around a pivot-pin 19 between a locked position and a released position. Pivot-pin 19 of latch 18 is advantageously parallel to second pivot-pin 10 of trigger 11.

A movable third flange-plate 20 is fitted rocking, advantageously on the end of first pivot-pin 8 between a closed position and an open position. A second cylindrical roller 21 is fitted rotating freely preferably around first pivot-pin 8, and is provided at its periphery with an annular groove for guiding the rope. Second roller 21 separates flange-plates 7 and 20.

A block 22 fixed to first flange-plate 7 is located above first aperture 14, occupying the transverse space between flange-plates 7 and 20. In this configuration, each surface of first flange-plate 7 is equipped with a block.

The open position of third flange-plate 20 enables the rope to be fitted in place. In the closed position of third flange-plate 20, the rope is wound in a loop on roller 21, and is held captive in the transverse gap arranged between flange-plates 7, 20. The third flange-plate is advantageously deformed in the area collaborating with block 22 so as to limit the protuberance formed by the block and to reduce the overall dimensions of first fixing means 1*a*.

Third flange-plate 20 comprises a first aperture 23 located above rotary roller 21. First aperture 23 of third flange-plate 20 comes into alignment with first aperture 14 when the two flange-plates 7 and 20 are in the closed position. Apertures 14, 15 and 23 define aperture 5*a*. It is then possible to insert a removable connector therein to secure flange-plates 7, 13 and 20 in this position preventing any undesirable rocking.

In the embodiment illustrated in FIGS. 4*a* and 4*b*, second fixing means 1*b* are formed by a double pulley devoid of any self-locking part. The two sheaves are mechanically associated in order to form a monoblock pulley 1*b*.

As illustrated in FIG. 4*b*, second fixing means 1*b* have a fixed first flange-plate 24 acting as support for a first pivot-pin 25 of a rotary roller 26.

Pivot-pin 25 is fixed and extends in a perpendicular direction to first flange-plate 24. Cylindrical roller 26 is mounted rotating freely around first pivot-pin 25, and is provided at its periphery with an annular groove for guiding the rope.

A mobile second flange-plate 27 is mounted rocking on the end of first pivot-pin 25 between a closed position and an open position. The open position of second flange-plate 27 enables the rope to be fitted in place. In the closed position of second flange-plate 27, rope 3 is wound on roller 26 and is held captive in the transverse gap arranged between flange-plates 24 and 27.

First flange-plate 24 comprises a first aperture 28 located above rotary roller 26. Second flange-plate 27 is provided with a second aperture 29 which comes into alignment with first aperture 28 when the two flange-plates 24 and 27 are positioned in the closed position. The two apertures partially define aperture 5*b*. It is then possible to insert a removable connector therein to secure flange-plates 24 and 27 in this position preventing any undesirable rocking.

A mobile third flange-plate 30 is mounted rocking, advantageously on the end of first pivot-pin 25 between a closed position and an open position. A second cylindrical roller 31 is mounted rotating freely preferably around first pivot-pin 25, and is provided at its periphery with an annular groove for guiding the rope. Second roller 31 separates flange-plates 24 and 30.

Second flange-plate 30 is provided with an aperture 32, which comes into alignment with first aperture 28 when the two flange-plates 24 and 30 are positioned in the closed position. The three apertures 28, 29 and 32 define aperture 5*b*. It is then possible to insert a removable connector therein to secure flange-plates 24, 27 and 30 in this position preventing any undesirable rocking.

A block 33 fixed to first flange-plate 24 is located above first aperture 28, occupying the transverse gap between flange-plates 24 and 27. Advantageously, block 33 is configured to occupy the transverse gap between flange-plates 24 and 30. In this configuration, each surface of first flange-plate 24 is equipped with a block.

The second and third flange-plates 27 and 30 are advantageously deformed in the area cooperating with block 33 so as to limit the transverse protuberance formed by block 33 and to reduce the overall dimensions of second fixing means 1*b*.

The invention claimed is:

1. A portable pulley device comprising:

a first pulley designed to be fixed to a fixed point and comprising a first set of at least one sheave, a second pulley designed to be fixed to a person to be rescued and comprising a second set of at least one sheave, a rope fixed to one of the first and second pulleys and arranged to connect the at least one sheave of the first pulley with the at least one sheave of the second pulley so that the first pulley moves towards the second pulley when a pull is exerted on the rope, a deformable enclosure connecting the first pulley to the second pulley and surrounding a path of the rope between the first and second pulleys, one end of the rope extending outwards from the enclosure to enable the pull to be exerted on said end, the deformable enclosure being removably attached to the first pulley and the second pulley, wherein the deformable enclosure is in direct contact with the first pulley and the second pulley.

2. The device according to claim 1, wherein the deformable enclosure comprises:

a first portion in contact with the first pulley, a second portion in contact with the second pulley and a third portion separating the first and second portions, and wherein the first and second portions are formed from a first material which is more rigid than a second material forming the third portion.

3. The device according to claim 2, wherein the third portion of the deformable enclosure is formed by a material drilled with holes.

4. The device according to claim 3, wherein the third portion of the deformable enclosure is formed by a netting.

5. The device according to claim 3, wherein the third portion of the deformable enclosure is formed by a textile material.

6. The device according to claim 2, wherein the first portion of the deformable enclosure comprises a first hole collaborating with at least one hole of the first pulley configured to allow for insertion of a first removable connector and wherein the second portion comprises a second hole collaborating with at least one hole of the second pulley configured to allow for insertion of a second removable connector.

7. The device according to claim 6, comprising the first removable connector and wherein the first hole of the first portion is arranged to allow passage of the first removable connector in the at least one hole of the first pulley.

8. The device according to claim 7, comprising the second removable connector and wherein the hole of the second portion is arranged to allow passage of the second removable connector in the at least one hole of the second pulley.

9. The device according to claim 1, wherein one of the first and second pulleys comprises a self-locking device configured to allow movement of the rope resulting in the two pulleys being moved towards one another and to block a movement of the rope in a opposite direction.

10. The device according to claim 1, wherein the deformable enclosure is flexible in a first direction connecting the first pulley to the second pulley, and is flexible in a second direction different from the first direction.

11. The device according to claim 1, wherein the deformable enclosure is flexible so as to allow the deformable enclosure to be folded or to allow torsion of a central part of the deformable enclosure.

12. The device according to claim 1, wherein the deformable enclosure defines a tube having a first end plugged by the first pulley and a second end plugged by the second pulley.

13. The device according to claim 1, wherein the deformable enclosure completely surrounds the rope in a plane perpendicular to an axis connecting the first pulley to the second pulley.

14. The device according to claim 1, wherein the deformable enclosure comprises a textile material or a fabric.

15. The device according to claim 1, wherein the deformable enclosure completely surrounds the first pulley and the second pulley in a plane perpendicular to an axis connecting the first pulley to the second pulley.

16. The device according to claim 1, wherein the rope is fixed to the one of the first and second pulley inside the deformable enclosure.

* * * * *